US006773003B2

(12) United States Patent
Dermody, Jr.

(10) Patent No.: US 6,773,003 B2
(45) Date of Patent: Aug. 10, 2004

(54) COMPOUND INVERTIBLE SOFT JAW FOR A MACHINE VISE

(76) Inventor: Donald Joseph Dermody, Jr., 139 Church Hill Rd., Eddyville, NY (US) 12401

( * ) Notice: Subject to any disclaimer, the term of this patent is extended or adjusted under 35 U.S.C. 154(b) by 233 days.

(21) Appl. No.: 09/995,424

(22) Filed: Nov. 27, 2001

(65) Prior Publication Data

US 2003/0098538 A1 May 29, 2003

(51) Int. Cl.[7] ..... B25B 1/20

(52) U.S. Cl. ..... 269/282; 269/43; 269/268; 269/283

(58) Field of Search ..... 269/282, 271, 269/259, 257, 43, 283, 268; 279/137, 152, 153

(56) References Cited

U.S. PATENT DOCUMENTS

| | | | | | |
|---|---|---|---|---|---|
| 4,422,629 | A | | 12/1983 | Carlson | 269/282 |
| 4,573,669 | A | | 3/1986 | Gerry | 269/271 |
| 4,602,772 | A | | 7/1986 | Wight et al. | 269/282 |
| 4,923,186 | A | * | 5/1990 | Durfee, Jr. | 269/282 |
| 5,150,888 | A | * | 9/1992 | Durfee | 269/254 CS |
| 5,193,792 | A | | 3/1993 | Di Marco | 269/282 |
| 5,244,194 | A | * | 9/1993 | Nishimura | 269/155 |
| 6,045,126 | A | | 4/2000 | Brzezinski | 269/282 |
| 6,126,158 | A | | 10/2000 | Engibarov | 269/136 |
| 6,152,435 | A | * | 11/2000 | Snell | 269/43 |
| 6,196,536 | B1 | * | 3/2001 | Hintze | 269/282 |

OTHER PUBLICATIONS

Kurt Standard D–Series Vise Products, Kurt Manufacturing Co., found www.kurt.com/IPDivision/index.cfm?page=vise01, date Sep. 28, 2001.

Kurt D–675 Vise, Kurt Manufacturing Co., found www.kurt.com/IPDivision/index.cfm?page=vise02, date Sep. 28, 2001.

* cited by examiner

*Primary Examiner*—Lee Wilson

(74) *Attorney, Agent, or Firm*—BK Patents, Inc.; Billy J. Knowles

(57) ABSTRACT

A compound soft jaw for use in a machine vise has a replaceable jaw member into which the templates of the workpieces are cut. The compound soft jaw has a primary jaw member secured to a receiving plate of the machine vice. The first secondary jaw member is secured to the primary jaw member. The first secondary jaw member is machined to have a cutting template formed therein such that as the workpiece is secured within the machine vise, the workpiece is machined according to the template. Upon completion of machining of the workpiece, the first secondary jaw member is replaceable by a second secondary jaw member into which a second cutting template is formed. The primary jaw member has a height less than a height of the receiving plate. The secondary jaw member is placed on the primary jaw member and is forced into contact with a surface of the receiving. The secondary jaw member is then supported by the receiving plate, which prevents the secondary jaw member from movement during securing the workpiece. The second secondary jaw member may be the first secondary jaw member removed from the primary jaw member, rotated or inverted, and re-secured to the primary jaw member, with a second cutting template formed therein.

39 Claims, 7 Drawing Sheets

COMPOUND INVERTIBLE SOFT JAW FOR A MACHINE VISE

BACKGROUND OF THE INVENTION

1. Field of the Invention

This invention relates to vises used to secure a workpiece for fabrication of components and parts. More particularly, this invention relates to replaceable soft jaws within the vise into which a workpiece is set and secured for machining.

2. Description of Related Art

Machine vises are employed in many different machine tools such as milling machines, shapers and drill presses for providing a gripping surface to support and secure a workpiece to the machine. The machine vises commonly have a stationary receiving plate and a movable receiving plate mounted in opposition to each other. Jaws are replaceably mounted upon each of the receiving plates for gripping a workpiece, as the movable receiving plate with its jaw is shifted toward the fixed receiving plate with its jaw.

The jaws may be formed from hardened steel or alloy compositions in order to permit their continued use over long periods of time. However, the jaws are commonly formed from relatively soft metals such as aluminum or aluminum alloys. The soft jaws are commonly used where it is desired to provide a particular gripping configuration on the face of the insert. For example, grooves or channels are commonly cut along the face or along one edge of the soft jaws in order to better adapt the soft jaws to a particular workpiece being secured by the vise.

A machinist generally cuts the grooves and channels cut into the soft jaws by first establishing an appropriate set of reference axes. From the reference axes, the operator then cuts the grooves and channels that effectively form a template. The soft jaws with the template formed therein is used to secure a workpiece during the machining, drilling, milling, cutting, and shaping to fabricate a finished item or part.

Upon completion of a run or fabrication of a requested lot of parts, it is common for the soft jaws with the template formed therein, to be removed from the machine vise for storage pending reuse. If another request for more parts is received the soft jaws are retrieved from storage and reattached to a machine vise. The machine vise used may not necessarily be the original vise used to fabricate the original parts. The machinist then attempts to align the soft jaws so as to establish the original reference axes. This is a difficult process requiring repeated trial and error to establish the reference axes and it is not uncommon to scrap of numerous parts. Often the machinist will become frustrated, reestablish the reference axes and re-cut the grooves and channels in the existing soft jaw until there can be no new template cuts made in the soft jaw. A new soft jaw is then cut to establish the reference axis and the template, thus causing not only waste of the original soft jaws, but also waste of time and material in attempting to reuse the original templated soft jaws.

U.S. Pat. No. 4,422,629 (Carlson) describes an accessory apparatus for vises that utilizes a pair of accessory members. One member has a Z-shaped cross-section and is secured to the stationary receiving plate of the vise. The other accessory member also has a Z-shaped cross-section that is secured to the moveable receiving plate of the vise. The accessory apparatus as described, provides three ranges of gripping areas. Two of the ranges are provided having zero radius gripping corners on the plates supporting the work clamped by the apparatus.

U.S. Pat. No. 6,126,158 (Engibarov) illustrates a soft jaw for a machine vise. The jaw assembly is used on a slideway of a machine table includes one or more guide rods over which a vise jaw freely slides. No fasteners or mounting members are required to mount and demount the jaw from the assembly. Before the jaw is tightened to apply a clamping force, it is held in an unbiased condition without the need for biasing springs.

U.S. Pat. No. 6,045,126 (Brzezinski) describes a vise jaw and a bolt to attach the vise jaw to the receiver plates of the vise.

U.S. Pat. No. 5,193,792 (Di Marco) describes a soft jaw attachment system for a vise. The soft jaw attachment is prestressed to ensure tightness of the attachment of the soft jaw to the vice jaw.

U.S. Pat. No. 4,602,772 (Wight, et al.) teaches a replaceable vise jaw insert assembly for mounting on either the fixed or movable vise jaw of a mill vise. The vise jaw insert assembly includes a clamping member. Facing surfaces of the clamping member and vise jaw are spaced apart and inclined relatively toward each other. An insert member having a wedge-shaped portion configured for generally mating engagement with the facing surfaces of the clamping member and vise jaw causes the wedge-shaped portion of the insert member to be captured between the clamping member and the vise jaw. The insert member is also formed with a gripping surface for securing a workpiece on the mill vise.

U.S. Pat. No. 4,573,669 (Gerry) describes a machine vise having jaw plates carried by each jaw of the machine vise. The jaw plates provide a steady rest structure and effectively and efficiently reduce the set up time required to arrange numbers of like pieces of work in predetermined clamped relationship within and between the jaw plates.

SUMMARY OF THE INVENTION

An object of this invention is to provide a compound soft jaw for use in a machine vise.

Another object of this invention is to provide a compound soft jaw for a machine vise where a template for a workpiece is formed in the compound soft jaw.

Further, another object of this invention is to provide a compound soft jaw for use in a machine vise where multiple templates for different workpieces may be formed within the compound soft jaw.

Still further, another object of this invention is to provide a compound soft jaw for use in a machine vise having a replaceable soft jaw member into which the templates of the workpieces are cut.

To accomplish at least one of these objects and other objects, a compound soft jaw includes a primary jaw member generally formed of steel and a first secondary jaw member generally formed of aluminum. The primary jaw member is secured to a receiving plate of the machine vice. The first secondary jaw member is secured to the primary jaw member. The first secondary jaw member is machined to have a cutting template formed therein such that as the workpiece is secured within the machine vise, the workpiece is machined according to the template. Upon completion of machining of the workpiece, the first secondary jaw member is replaceable by a second secondary jaw member into which a second cutting template is formed.

The primary jaw member has a height less than a height of the receiving plate. The secondary jaw member is placed on the primary jaw member and is forced into contact with a surface of the receiving plate onto which the primary jaw member is secured. The secondary jaw member as forced to the receiving plate is then supported by the receiving plate and prevents the secondary jaw member from movement during securing the workpiece within the machine vise.

Rather than replace the first secondary jaw member, the second secondary jaw member may in fact be the first secondary jaw member. The first secondary jaw member is removed from the primary jaw member, rotated or inverted, and re-secured to the primary jaw member, with a second cutting template formed therein.

The compound soft jaw has at least one fastener of a first type to secure the primary jaw member to the receiving plate. Preferably there are two of the first type fasteners with which to secure the primary jaw member to the receiving plate. The two first type fasteners secure the primary jaw member to the receiving plate with a torque of greater than approximately 250 in./lbs. and are ½"×13 cap screws. The cap screws are placed in openings formed in the primary jaw member so as to secure the primary jaw member fastener to the receiving plate.

The compound soft jaw further includes at least one of a second type fastener to secure the secondary jaw member to the primary jaw member. Preferably there are three second type fasteners that secure the secondary jaw member to the primary jaw member. The three second type fasteners secure the secondary jaw member to the primary jaw member with a torque of greater than approximately 250 in./lbs. and are ¼"×20 cap screws. The cap screws are placed in opening in the secondary jaw member to secure the secondary jaw member to the primary jaw member.

The primary jaw member, in addition to being formed of steel, may be formed of a material such as aluminum, brass, copper, plastic, wood, wood products. Similarly, the secondary jaw member, in addition to being formed of aluminum, may be formed of a material such as steel, brass, copper, plastic, wood, or wood products.

DETAILED DESCRIPTION OF THE INVENTION

In fabrication of a machined part, a machine operator secures jaw plates to the fixed and moveable receiving plates of a machine vise, The operator then establishes the reference axis for the machine tool relative to the vise and then, if required, cut a template into the jaw plates. A workpiece is secured within the jaw plates to the machine vise and the workpiece is machined to create the desired parts. At the completion of a run or group of parts, the jaw plates are removed from the receiving plates and stored.

If another run of parts is desired, the jaw plates are reattached to the receiving plates. The machinist must now correspond the reference axes of the jaw plates with the reference axes of the machine vise and with the machine tool. This requires an inordinate amount of time using dial indicators and often is not possible causing the machine operator to recut the existing jaw plates or "scrap" the jaw plates and fabricate a new set of jaw plates with a new template.

The inventor has observed that the majority of templated jaws have less than one third of the top surface of the soft jaw machined for the template. Further, the inventor observed that the generally less than one third of the depth from the top of the soft jaw is machined for the template. Very rarely were the soft jaws machined to a level encroaching on the hold down fasteners or screws for the jaw plates. Generally, the jaw plates are constructed of a relatively soft material such as aluminum and if scrapped after a single use, these jaw plates become a relatively large expense.

Figure 1:
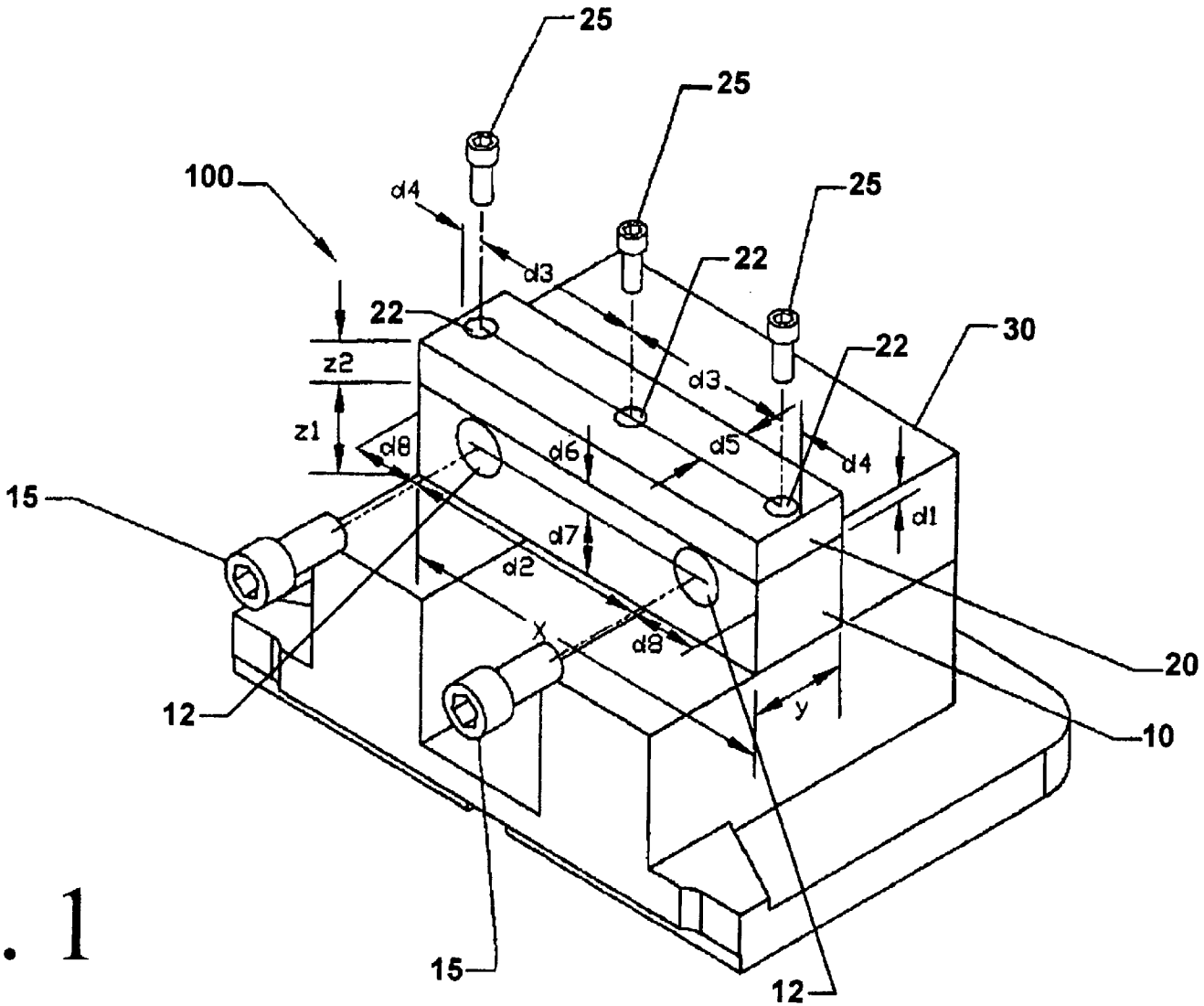
FIG. 1 is three-dimensional drawing of a compound soft jaw of this invention.
Figure 2A:
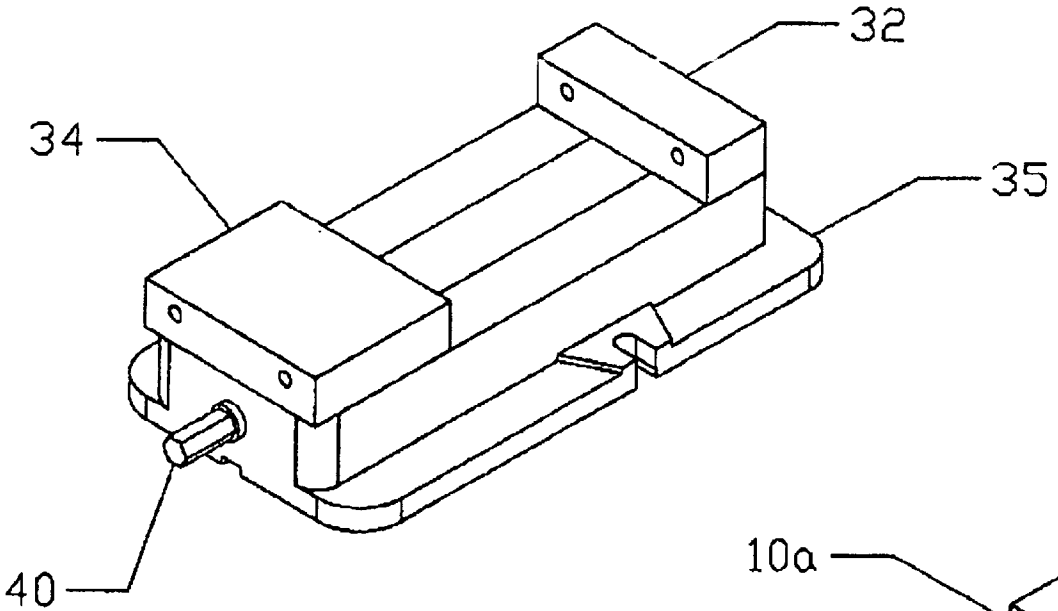
FIGS. 2*a*–2*i* are three-dimensional drawings showing the installation and use of the compound soft jaw of this invention in a machine vise.
Figure 2B:
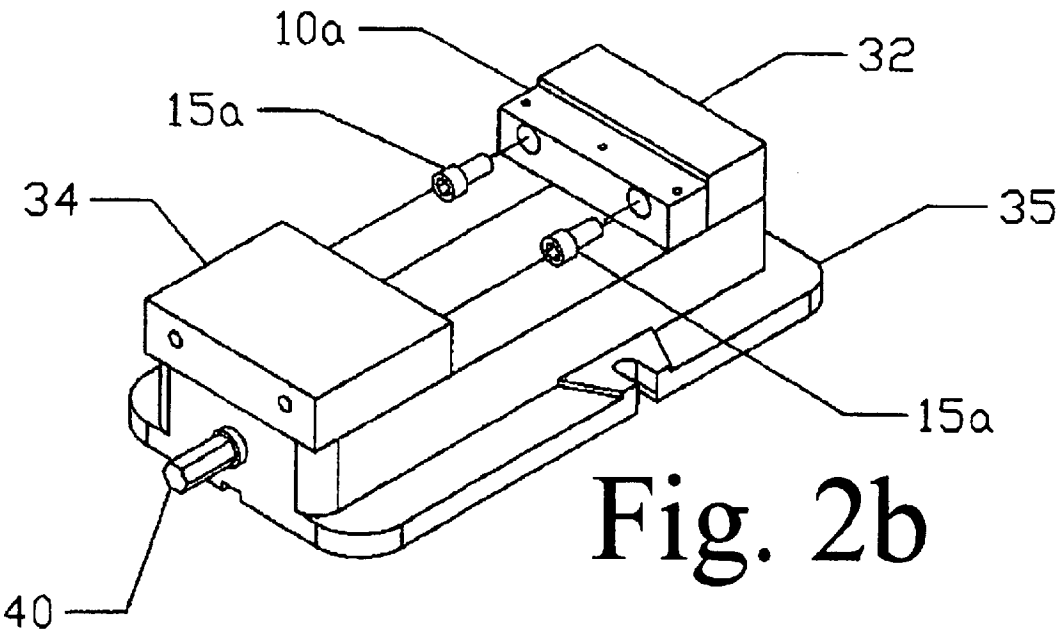
Figures 2C, 2D:
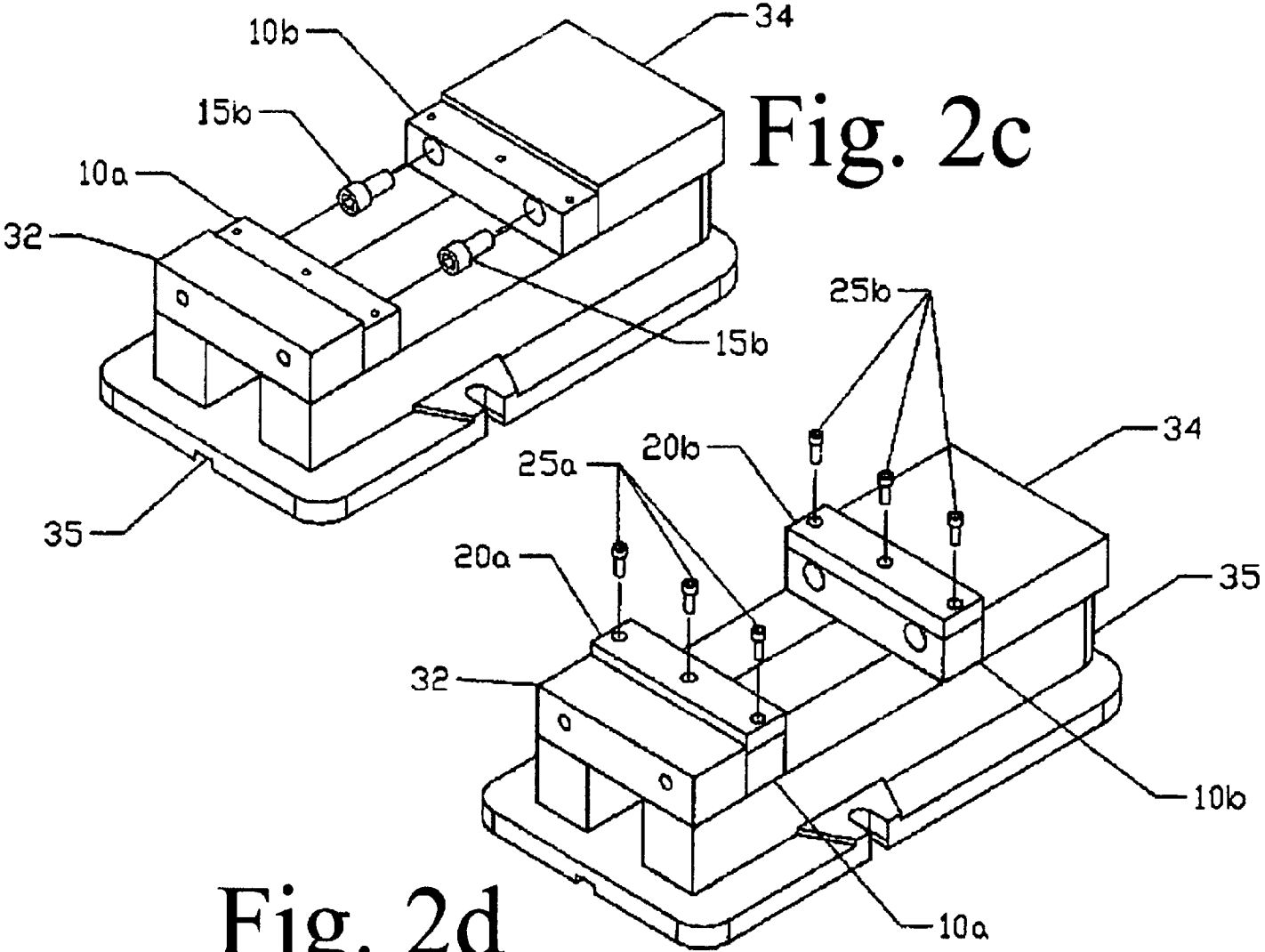
Figures 2E, 2F:
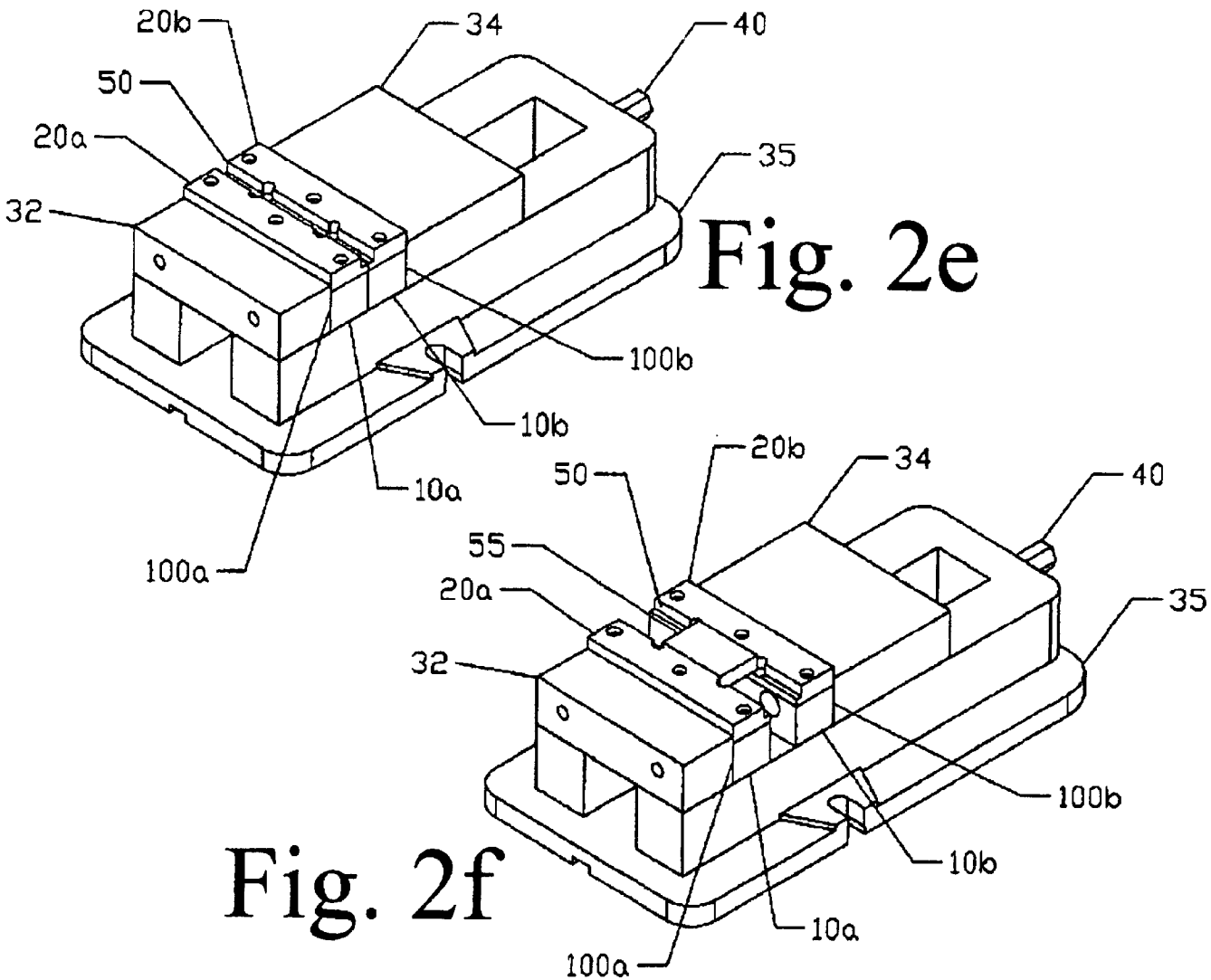
Figure 2G:
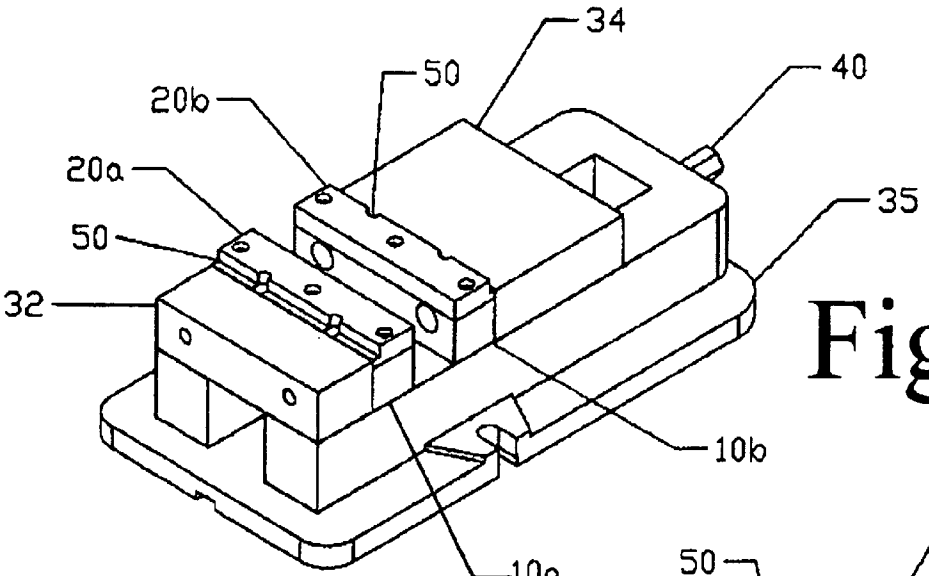
Figure 2H:
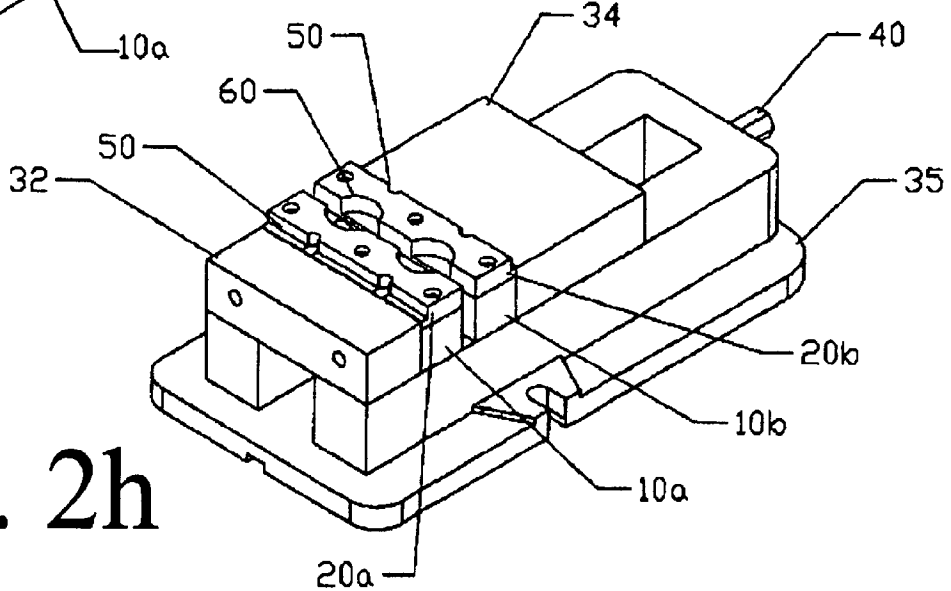
Figure 2I:
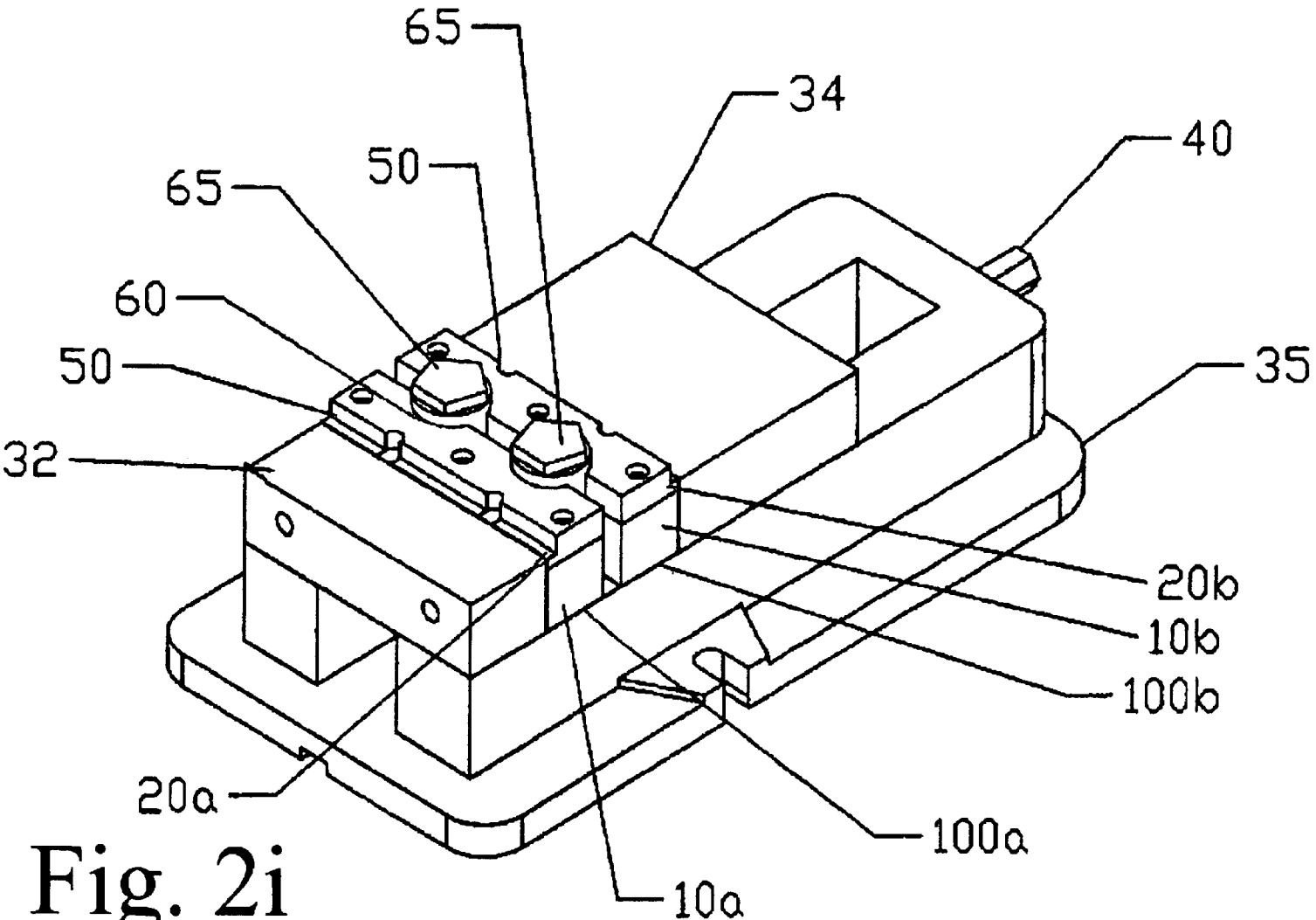

The compound soft jaw plate of this invention allows a machine operator to quickly establish the reference axes of the machine tool and to provide an inexpensive method of providing a repeatable template to retain a workpiece for machining. Refer now to FIG. 1 for a description of the structure of the compound soft jaw 100 of this invention.

A primary jaw piece 10 is generally constructed of steel in the form a first rectangular solid. The first rectangular solid alternately may be formed of materials such as aluminum, brass, copper, plastic, solid wood, or composite wood products. The rectangular solid is then drilled and counter-bored to have the openings 12 that accept the two cap screw fasteners 15. A secondary jaw piece 20 is constructed of a soft material such as aluminum in the form a second rectangular solid. The secondary jaw piece 20 alternately is formed of materials such as steel, brass, copper, plastic, solid wood, or composite wood products. The second rectangular solid is then drilled and counter-bored to form the openings 22 to accept the three cap screw fasteners 25. The first rectangular solid is then drilled and tapped to have openings in alignment with the openings 22 to accept the second cap screw fasteners.

The dimensions of the compound soft jaw 100 of this invention are predicated generally on the style and size of the machine vise being used to retain the workpiece. In the preferred embodiment the machine vise is an industry standard 6" machine vise (portions of which are shown in FIG. 1). The length x of the primary jaw piece 10 and the secondary jaw piece 20 is approximately the width or "X" dimension of the receiving plate 30 of the vise or approximately 6.00". The depth y of the primary jaw piece 10 and the secondary jaw piece 20 is determined by the size of the work piece and the template openings required to form the part, but is generally approximately 1.500" in depth or the "Y" dimension. The height $z_1$ of the primary jaw piece 10 must be less than the height or "Z" dimension of the receiving plate 30 and is generally approximately 1.375". The height $z_2$ of the secondary jaw piece 20 is determined by the dimensions of the workpiece and the depth of the template cuts required to be formed in the secondary jaw piece 20 for machining the final part. Generally the secondary jaw piece 20 has a height $z_2$ of approximately 0.625'.

The drilled and counter bored openings 12 in the primary jaw piece 10 are formed to align with drilled and tapped openings in the receiving plate 30. The drilled and tapped openings in the receiving plate 30 are formed in the receiving plate at the time of the manufacture of the machine vise. Generally, the centerline of the drilled and counter bored openings 12 is at a distance $d_7$ of approximately 0.925" from the bottom of the primary jaw piece 12. While the distance $d_6$ of the center line of the drilled and counter bored openings 12 from the top of the primary jaw piece 10 is not critical and is dependent on the height of the primary jaw piece 10. The dimension $d_6$ is approximately 0.450". The drilled and counter bored openings 12 in the primary jaw piece 10 are separated by a distance $d_2$ that is approximately 3.875". The distance $d_8$ from the end of the primary jaw piece 10 is approximately 1.0625".

The drilled and counter bored openings 22 in the secondary jaw piece and the openings in the primary jaw piece are placed such that the secondary jaw piece 20 can be rotated 180° or inverted to allow multiple surfaces to cut for templates of different parts or production runs of parts. The drilled and counter bored openings 22 are generally centered upon the top surface of the secondary jaw piece 20. In the preferred embodiment, the centerline of the drilled and counter bored openings 22 is placed at a dimension $d_5$ that is approximately 0.750" from either side edge of the secondary jaw piece 20. The drilled and counter bored openings 22 are separated by a dimension $d_3$ that is approximately 2.665". The center drilled and counter bored opening of the drilled and counter bored openings 22 is essentially centered on the secondary jaw piece 20. The remaining two drilled and counter bored openings of the drilled and counter bored openings 22 are placed to avoid interference with the tapped and drilled openings 22 and the cap screw fasteners when they are placed in their openings 22. Preferably, the openings of the drilled and counter bored openings 22 nearest the edges of the secondary jaw piece 20 are placed a distance $d_4$ from the edges. This distance ($d_4$) being approximately 0.335".

The cap screw fasteners 15 preferably are ½×13 socketed cap screws and the cap screw fasteners 25 are preferable ¼×20 socketed cap screws. Other fastener systems may be used to secure the primary jaw piece 10 to the receiver plate 30 and the secondary jaw piece 20 to the primary jaw piece 10 and still be in keeping with the intent of this invention.

The primary jaw piece 10 is secured to the receiving plate 30 by the cap screw fasteners 15. Generally the cap screw fasteners 15 are secured tightly by receiving plate often using a level bar to multiply the torquing. However, this method secures the cap screw fasteners 15 with a torque of greater than approximately 250 in./lbs. The secondary jaw piece 20 is secured to the hard jaw plate 10 by the cap screw fasteners 25. Similarly, the cap screw fasteners 25 are fastened using a lever bar and thus achieving a torque greater than approximately 250 in./lbs. During the torquing of the cap screw fasteners 15, the secondary jaw piece 20 is forced to the receiving plate to insure that the secondary jaw piece is in full contact with the receiving plate 30.

The secondary jaw piece 20 is then machined to provide the template for the workpiece. The template allows a machine tool to fashion the finished part. Upon completion of a production run for fashioning parts, a next part to be fabricated can be set up. The secondary jaw piece 20 is then removed and is either discarded or reversed and/or inverted. The secondary jaw piece 20 is then reattached and then re-cut to form the template for the next part to be fabricated.

The secondary jaw piece 20 is sufficiently small such that it is relatively inexpensive. Replacing the secondary jaw piece 20 and cutting and re-cutting the templates in the soft jaws is much less costly than attempting to realign the reference axes of an existing pair of vise jaws as described.

Refer now to FIGS. 2*a*–2*i* for a more detailed description of the method for forming and use the compound soft jaws of this invention. A machine vise has a base member 35 that is attached to a machine tool to secure a workpiece to the machine tool. A fixed receiving plate 32 is permanently affixed to the base member 35. The moveable receiving plate 34 is coupled to an adjustment mechanism 40, which allows the moveable receiving plate 34 to advance to the fixed receiving plate 32.

A first primary jaw piece 10*a* is formed as described in FIG. 1 and secured by the cap screw fasteners 15*a* to the fixed receiving plate 32. The cap screwfasteners 15*a* are secured with a torque of 250 in./lbs. A second primary jaw piece 10*b* is formed as described in FIG. 1 and secured by the cap screw fasteners 15*b* to the moveable receiving plate 34. The cap screw fasteners 15*b* are also secured with a torque of 250 in./lbs. A first secondary jaw piece 25*a* and a second secondary jaw piece 25*b* are formed as described in FIG. 1 and secured respectively to the hard jaw plates 10*a* and 10*b* by the two sets of three cap screw fasteners 25*a* and 25*b*. The secondary jaw pieces are forced into firm contact with the fixed and moveable receiving plates, while the two sets of three cap screw fasteners 25*a* and 25*b* are secured with a torque of 250 in./lbs.

The moveable receiving plate 32 is advanced by the adjustment mechanism 40 until the opposing surfaces of the compound soft jaws 100*a* and 100*b* are in firm contact. A first template 50 is then cut into the top surfaces of the secondary jaw pieces 10*a* and 10*b*. The moveable receiving plate 32 is moved by the adjustment mechanism 40 to open the spacing between the compound soft jaws 100*a* and 100*b*. The workpiece 55 is placed and aligned within the templated compound soft jaws 100*a* and 100*b*. The moveable receiving plate 34 is again advanced by the adjustment mechanism 40 until the workpiece 55 is secured. The workpiece 55 is then machined by the machine tool to create a finished part.

Upon completion of the finished part, the cap screw fasteners 25*a* and 25*b* are extracted to free the secondary jaw pieces 20*a* and 20*b* from the primary jaw pieces 10*a* and 10*b*. The secondary jaw pieces 20*a* and 20*b* are then discarded and replaced by newly formed secondary jaw pieces 20*a* and 20*b* or the original secondary jaw pieces 20*a* and 20*b* are rotated 180° or inverted and re-secured to the primary jaw pieces 10*a* and 10*b* by the cap screw fasteners 25*a* and 25*b*.

While the original secondary jaw pieces 20*a* and 20*b* may inverted, generally the edge of the original secondary jaw pieces 20*a* and 20*b* are cut with the template. This often precludes the inversion of the original secondary jaw pieces 20*a* and 20*b* and cutting the bottom surface with a new template. However, the structure of the original secondary jaw pieces 20*a* and 20*b* is such that they maybe inverted for use of all edges of the original secondary jaw pieces 20*a* and 20*b*.

The moveable receiver plate 34 is advanced by the adjustment mechanism 40 until the opposing surfaces of the compound soft jaws 100*a* and 100*b* are firmly in contact. The secondary jaw pieces 20*a* and 20*b* are then cut with a second template 60 that determines a second part to fabricated. The moveable receiver plate 34 is moved to separate the compound soft jaws 100*a* and 100*b* to allow a second workpiece 65 to be placed and aligned within the compound soft jaws 100*a* and 100*b*. The moveable receiving plate 34 is advanced by the adjustment mechanism 40 to secure the workpiece 65 and the workpiece is machined according to the template 60.

As can be seen, the first template 50 is now on the surfaces of the secondary jaw pieces 20*a* and 20*b* in contact with the fixed and moveable receiving plates 32 and 34. The second template is on the surface of the secondary jaw pieces 20*a* and 20*b* that secure the workpiece 65. The preferred embodiment, as shown, uses only the top surfaces of the secondary jaw pieces 20*a* and 20*b*. A different choice of fastener to secure the secondary jaw pieces 20*a* and 20*b* to the primary jaw pieces 10*a* and 10*b* will allow the secondary jaw pieces 20*a* and 20*b* to be inverted.

Figure 3:
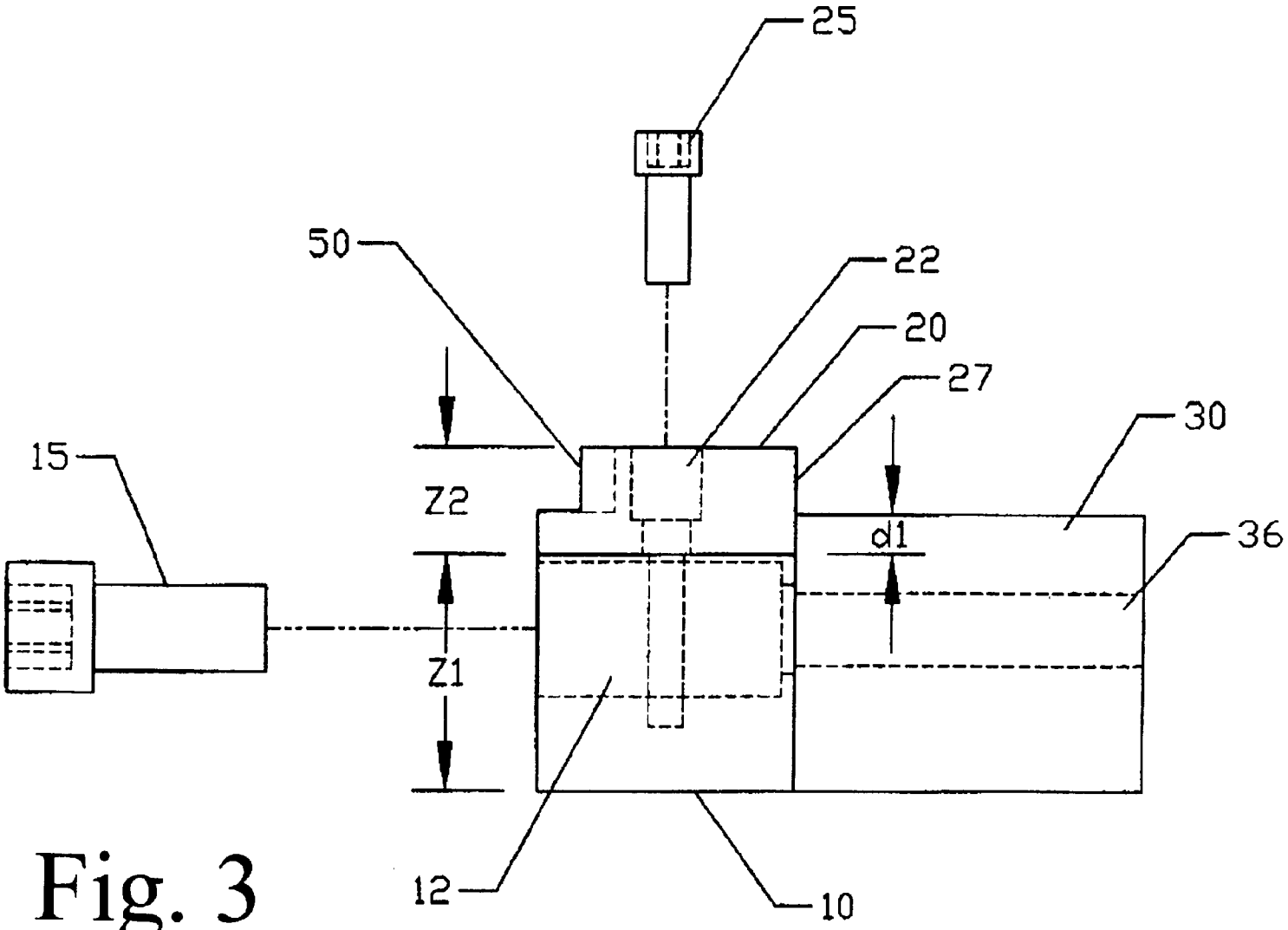
FIG. 3 is a side plan view of the compound soft jaw of this invention.

To summarize the key points of this invention refer now to FIG. 3 The hard block piece 10 is formed with the drilled and tapped openings 12 and 22. The openings 12 are placed to align with the openings 36 that are generally created during manufacturing of the receiver plate 30 The openings 22 are placed symmetrically to allow the secondary jaw pieces to be rotated when preparing for a second fabrication run or to be even inverted The height $z_1$ of the primary jaw piece 10 must be less than the height of the receiver plate 30 by an amount $d_1$. To prevent movement of the soft jaw plate 20, the distance $d_1$ is sufficient to allow the secondary jaw piece 20 to be in contact with and have support from the receiving plate 30.

The secondary jaw piece 20 is formed with the openings 22 and secured by the cap screw fasteners 25 to the primary jaw piece 10. The template 50 is cut into the secondary jaw piece 20 to determine the structure of the first part to be fabricated. After completion of the fabrication of the first part, the secondary jaw piece 20 is then removed, rotated, and re-secured to the primary jaw piece 10. The surface 27 of the secondary jaw piece 20 is then cut for the second template 60 of FIG. 2*h*. The cutting of a new template with each new fabrication of a machined part allows accurate determination of the reference axis and accurate cutting of the template. This prevents waste and loss of time trying to re-establish a reference axis as in the jaw plates of the prior art.

While this invention has been particularly shown and described with reference to the preferred embodiments thereof, it will be understood by those skilled in the art that various changes in form and details may be made without departing from the spirit and scope of the invention.

The invention claimed is:

1. A compound soft jaw to retain a workpiece within a machine vise comprising:

a primary jaw member secured to a receiving plate of said machine vice; and a first secondary jaw member secured to said primary jaw member, said first secondary jaw member being machined to have a cutting template formed therein such that as the workpiece is secured within said machine vise, said workpiece is machined according to said template;

wherein the primary jaw member has a height less than a height of the receiving plate and said secondary jaw member is forced into contact with a surface of the receiving plate onto which said primary jaw member is secured, such that said secondary jaw member is supported by the receiving plate and prevent from movement during securing said workpiece within said machine vise; and wherein upon completion of machining of said workpiece, said first secondary jaw member is replaceable by a second secondary jaw member into which a second cutting template is formed.

2. The compound soft jaw of claim 1 wherein said second secondary jaw member is the first secondary jaw member removed from said primary jaw member, rotated, and re-secured to said primary jaw member, with a second cutting template formed therein.

3. The compound soft jaw of claim 1 further comprising at least one of a first type fastener to secure the primary jaw member to the receiving plate.

4. The compound soft jaw of claim 3 wherein the primary jaw member has openings formed therein to accept said fasteners so as to secure said primary jaw member fastener to said receiving plate.

5. The compound soft jaw of claim 1 wherein two of the first type fasteners secure the primary jaw member to the receiving plate.

6. The compound soft jaw of claim 5 wherein the two first type fasteners secure the primary jaw member to the receiving plate with a torque of greater than approximately 250 in./lbs.

7. The compound soft jaw of claim 5 wherein the two first type fasteners are ½ "×13 cap screws.

8. The compound soft jaw of claim 1 wherein the primary jaw member is formed of a material selected form the group of materials consisting of aluminum, steel, brass, copper, plastic, wood, and wood products.

9. The compound soft jaw of claim 1 further comprising at least one of a second type fastener to secure the secondary jaw member to the primary jaw member.

10. The compound soft jaw of claim 9 wherein three second type fasteners secure the secondary jaw member to the primary jaw member.

11. The compound soft jaw of claim 10 wherein the three second type fasteners secure the secondary jaw member to the primary jaw member with a torque of greater than approximately 250 in./lbs.

12. The compound soft jaw of claim 10 wherein the three second type fasteners are ¼ "×20 cap screws.

13. The compound soft jaw of claim 1 wherein the first and second secondary jaw members are formed of materials selected form the group of materials consisting of aluminum, steel, brass, copper, plastic, wood, and wood products.

14. A machine vise for securing a workpiece for machining comprising:

a vise base joined to a machine tool;

a first receiving plate coupled to said vise base;

a second receiving plate coupled to said vise base such that the first and second receiving plates are movable adjustable to retain said workpiece;

a first compound soft jaw attached to the first receiving plate; and a second compound soft jaw attached to the second receiving plate such that the workpiece is retained between the first and second compound soft jaws for machining by said machine tool;

said first and second compound soft jaws each comprising:

a primary jaw member secured to one receiving plate of the first and second receiving plates; and a first secondary jaw member secured to said primary jaw member, said first secondary jaw member being machined to have a cutting template formed therein such that as the workpiece is secured within said machine vise, said workpiece is machined according to said template;

wherein the primary jaw member has a height less than a height of the receiving plate and said secondary jaw member is forced into contact with a surface of the receiving plate onto which said primary jaw member is secured, such that said secondary jaw member is supported by the receiving plate and prevent from movement during securing said workpiece within said machine vise; and wherein upon completion of machining of said workpiece, said first secondary jaw member is replaceable by a second secondary jaw member into which a second cutting template is formed.

15. The machine vise of claim 14 wherein said second secondary jaw member is the first secondary jaw member removed from said primary jaw member, rotated, and re-secured to said primary jaw member, with a second cutting template formed therein.

16. The machine vise of claim 14 further comprising at least one of a first type fastener to secure the primary jaw member to the receiving plate.

17. The machine vise of claim 16 wherein the primary jaw member has openings formed therein to accept said fasteners so as to secure said primary jaw member fastener to said receiving plate.

18. The machine vise of claim 14 wherein two of the first type fasteners secure the primary jaw member to the receiving plate.

19. The machine vise of claim 18 wherein the two first type fasteners secure the primary jaw member to the receiving plate with a torque of greater than approximately 250 in./lbs.

20. The machine vise of claim 18 wherein the two first type fasteners are ½"×13 cap screws.

21. The machine vise of claim 14 wherein the primary jaw member is formed of a material selected form the group of materials consisting of aluminum, steel, brass, copper, plastic, wood, and wood products.

22. The machine vise of claim 14 further comprising at least one of a second type fastener to secure the secondary jaw member to the primary jaw member.

23. The machine vise of claim 22 wherein three second type fasteners secure the secondary jaw member to the primary jaw member.

24. The machine vise of claim 23 wherein the three second type fasteners are ¼"×20 cap screws.

25. The machine vise of claim 23 wherein the three second type fasteners secure the secondary jaw member to the primary jaw member with a torque of greater than approximate 250 in./lbs.

26. The machine vise of claim 14 wherein the first and second secondary jaw members are formed of materials selected form the group of materials consisting of aluminum, soft steel, brass, copper, plastic, wood, and wood products.

27. A method for clamping a workpiece to secure said workpiece for machining comprising the steps of:

providing and joining a vise base to a machine tool;

coupling a first receiving plate to said vise base;

coupling a second receiving plate to said vise base such that the first and second receiving plates are movably adjustable with respect to each other to retain said workpiece;

forming and attaching a first compound soft jaw to the first receiving plate;

forming and attaching a second compound soft jaw to the second receiving plate; and retaining the workpiece between the first and second compound soft jaws for machining by said machine tool;

said first and second compound soft jaws each formed and attached by the steps of:

constructing a primary jaw member to a height less than a height of the receiving plate, securing said primary jaw member to a one receiving plate of the first and second receiving plates, and constructing a first secondary jaw member, securing said first secondary jaw member to said primary jaw member, by the step of forcing said secondary jaw member into contact with a surface of the receiving plate onto which said primary jaw member is secured, such that said secondary jaw member is supported by the receiving plate and prevent from movement during securing said workpiece within said machine vise, machining said first secondary jaw member to form a cutting template therein such that upon retaining the workpiece, said workpiece is machined according to said template, upon completing machining of said workpiece, replacing said first secondary jaw member by a second secondary jaw member, and machining a second cutting template into said second secondary jaw member for machining of a subsequent workpiece.

28. The method of claim 27 further comprising steps of:

forming the second secondary jaw member by the steps of:

removing the first secondary jaw member from said primary jaw member, rotating, and re-securing said first secondary jaw member to said primary jaw member.

29. The method of claim 27 wherein securing the primary jaw member to one receiving plate of the first and second receiving plates comprises the steps of:

providing at least one of a first type fastener, attaching said first fastener type to said primary jaw member, and securing said primary jaw member to the receiving plate.

30. The method of claim 29 wherein two of the first type fasteners secure the primary jaw member to the receiving plate.

31. The method of claim 30 wherein the two first type fasteners secure the primary jaw member to the receiving plate with a torque of greater than approximately 250 in/lbs.

32. The method of claim 30 wherein the two first type fasteners are ½"×13 cap screws.

33. The method of claim 29 further comprising the steps of:

forming openings in said primary jaw member to accept said fasteners so as to secure said primary jaw member fastener to said receiving plate.

34. The method of claim 27 wherein the primary jaw member is formed of a material selected form the group of materials consisting of aluminum, soft steel, brass, copper, plastic, wood, and wood products.

35. The method of claim 27 wherein securing the secondary jaw member to the primary jaw member comprises the steps of:

providing at least one of a second type fastener, attaching said second fastener type to said secondary jaw member, and securing the secondary jaw member to the primary jaw member.

36. The method of claim 35 wherein three second type fasteners secure the secondary jaw member to the primary jaw member.

37. The method of claim 36 wherein the three second type fasteners secure the secondary jaw member to the primary jaw member with a torque of greater than approximately 250 in./lbs.

38. The method of claim 36 wherein the three second type fasteners are ¼ "×20 cap screws.

39. The method of claim 27 wherein the first and second secondary jaw members are formed of materials selected from the group of materials consisting of aluminum, soft steel, brass, copper, plastic, wood, and wood products.

* * * * *